United States Patent [19]

Erpenbeck

[11] 4,114,266

[45] Sep. 19, 1978

[54] APPARATUS AND METHOD FOR ROTARY CUTTING OF ROLLED WINDOW SHADES AND THE LIKE

[75] Inventor: Paul J. Erpenbeck, Muskegon, Mich.

[73] Assignee: Breneman, Inc., Cincinnati, Ohio

[21] Appl. No.: 773,439

[22] Filed: Mar. 2, 1977

[51] Int. Cl.[2] ..... B25F 3/00; B26B 14/00; B26B 27/00; B26D 3/00

[52] U.S. Cl. ..... 30/123; 30/90.1; 30/96; 82/47

[58] Field of Search ..... 30/90.1, 92, 93–96, 30/123 R; 81/9.5 C; 82/47

[56] References Cited

U.S. PATENT DOCUMENTS

| | | | |
|---|---|---|---|
| 2,615,516 | 10/1952 | Hyde | 30/123 R |
| 3,151,510 | 2/1963 | Bunker et al. | 81/9.5 C |
| 3,620,104 | 11/1971 | Horrocks | 81/9.5 C |
| 3,798,565 | 3/1974 | Mattsson | 30/96 |

*Primary Examiner*—Othell M. Simpson
*Assistant Examiner*—Weiderfeld
*Attorney, Agent, or Firm*—Price, Heneveld, Huizenga & Cooper

[57] ABSTRACT

An apparatus and method for cutting rolled window shades, and the rollers on which they are mounted, includes a shade holder having a generally cylindrical tubular handle with a longitudinal central opening and a disc-like, annular cutting guide extending transversely outward from the end of the handle. In one form of the apparatus, the handle and guide are longitudinally split into two pieces and hinged at one side of the guide so the shade holder can swing open to receive a shade. In another form, the handle and guide are slotted longitudinally so as to be diametrically variable. A generally annular blade holder has a circumferential guide groove opening inwardly towards the center of the blade holder for engaging the outwardly-extending cutting guide on the shade holder. The blade holder supports a blade having a cutting edge positioned normal to the longitudinal axis of the shade holder and adjacent the end of the shade holder. For cutting, the shade and shade roller are held together within the tubular handle, which is clamped diametrically around them, and the blade holder is rotated relative to the shade holder to apply cutting action around the entire circumference of the rolled shade.

14 Claims, 13 Drawing Figures

APPARATUS AND METHOD FOR ROTARY CUTTING OF ROLLED WINDOW SHADES AND THE LIKE

BACKGROUND OF THE INVENTION

1. Field of the Invention

This invention relates generally to shade cutting devices and methods; and, more particularly, to portable, relatively simple and inexpensive devices for trimming shades to desired widths using a method of rotational cutting.

2. Prior Art

The prior art teaches various apparatuses and methods for changing the effective width of a window shade and/or its roller, so that it will fit properly in a window of a particular size. Various heavy, stationary lathe-type cutting machines are known and used at permanent locations, such as stores selling window shades, to cut rolled window shades and their rollers to desired lengths. Such machines are relatively complex to operate and relatively expensive. Further, since such machines are located away from the window where a shade is to be mounted, direct measurement of the window shade by placing the window shade against the window is typically not possible, and indirect measurement, increasing the possibility of error, must be relied upon. Undesirable consequences can include waste of a window shade cut too narrow and the need for returning to the store for a second trimming operation of a window shade cut too wide.

The prior art also teaches only very few portable window shade trimming devices, and those previously known have a relatively complex structure.

Further, their relative expense makes them more suitable for tradesmen making relatively frequent use of a trimming device than for single or occasional use by a window shade consumer. The cost of such prior portable trimming devices in relation to the cost of a window shade is significant, and even prohibitive, being undesirably high for only single or occasional use. Also, known or potentially usable portable window shade trimming devices often lack means for positioning the device securely to the window shade at the desired cutting position or lack means for positively applying a sufficiently strong cutting force to the window shade and roller.

Typical methods of operation of the apparatus of the prior art involve either a relatively complex set-up of the stationary shade trimming machine or a relatively skilled operation of a portable trimming device. It would therefore be very desirable to have a relatively simple and foolproof method to be used by an untrained person at the location of the shade installation. The method should be easy to execute, should be completely reliable, should produce accurate results, should provide adequate safety, and must produce a cut shade with an acceptable appearance.

SUMMARY OF THE INVENTION

A manual shade cutter assembly has an elongated, longitudinally slotted, and diametrically contractible shade holder with a cylindrical handle, for supporting a rolled shade during cutting within a longitudinal central opening. The shade holder has an integral annular cutting guide projecting transversely from an extremity of the handle, defining a generally circular flange adjacent the location to be cut on the rolled shade. An integrally hinged annular blade holder having a circular recessed groove facing the center of the blade holder fits around the cutting guide. A blade positioned within the blade holder has a cutting edge extending toward the rolled shade.

As a first step in using the shade cutter, a rolled shade is positioned within the shade holder so that the position of the desired cut along the length of the rolled shade is adjacent the cutting guide. The blade holder is rotationally mounted on the cutting guide and a force is applied so the blade cuts the shade generally along a plane perpendicular to the axis on which the shade is rolled. At the same time, force is applied to the shade holder to prevent relative motion between the shade holder and the shade, and the blade holder is rotated about the shade holder to apply a cutting action around the entire circumference of the rolled shade.

The shade cutter is of such simplicity from a manufacturing and assembly point of view that it can be supplied to the purchaser of a shade for use at home at very low cost. Also, the operation of the shade cutter is simple enough for an untrained person to use and to produce a cut shade having a very satisfactory appearance. In particular, the ability to clamp the shade holder onto the shade at a position adjacent the desired cut and to use an automatically-positioned integral cutting guide to rotationally guide the blade holder produces a cut which has an essentially perfect straight edge and avoids undesirable scallops. The ability of the window shade purchaser to be able to trim a window shade at the location of the window is extremely advantageous because, typically, greater accuracy can be obtained by directly measuring the shade against the window where it is to be mounted, rather than by measuring the window opening as by such means as a yardstick, noting the measurement, writing it down, taking the measurement to a store, and having a clerk cut the shade on the basis of the measurement written down.

DETAILED DESCRIPTION OF THE PREFERRED EMBODIMENT

Figure 1:
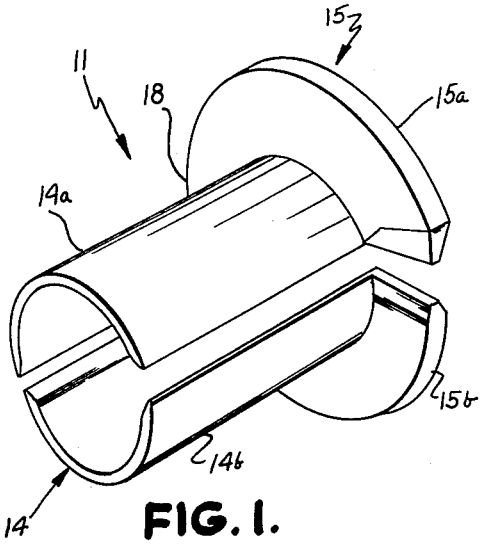
FIG. 1 is a rear perspective view of a shade holder in accordance with a first embodiment of this invention.
Figure 3:
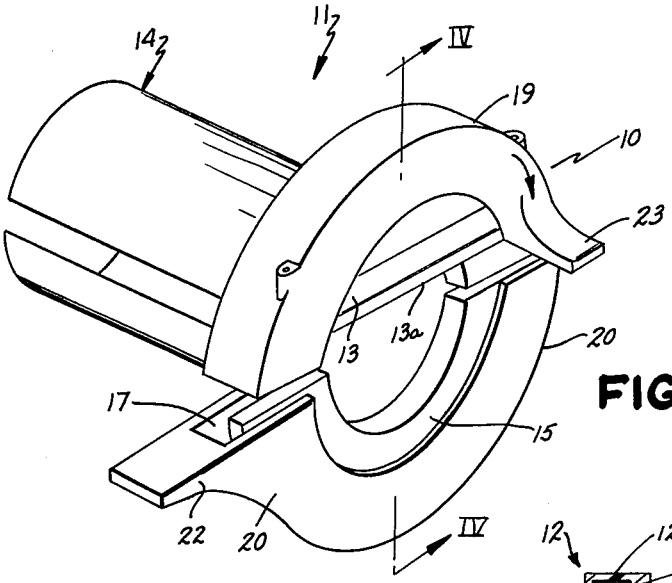
FIG. 3 is a front perspective view of the assembled shade holder and cutting in accordance with the preceding figures.

Referring to the drawings, a shade cutter assembly 10 (FIG. 3) includes a shade holder 11, shown separately in FIG. 1, (or a shade holder 111, shown in FIG. 9) having a cylindrically shaped, generally tubular handle 14, with a central longitudinal opening for receiving a rolled shade, and an integral cutting guide 15 having a disc-like flange extending radially outward from one extremity of the handle 14. Shade cutter assembly 10 further includes an annular blade holder 13, having a circular guide groove 17 opening radially inwardly and a blade mounting slot 16 (discussed in more detail subsequently) for mounting a blade 13 parallel to the plane of guide groove 17. Blade holder 12 is rotationally mounted on shade holder 11 with cutting guide 15 received within guide groove 17, thereby restricting blade holder 12 to circumferential rotation around shade holder 11 in the plane of cutting guide 15.

Cylindrical shade holder, or clamp, and handle 14 of shade holder 11 is longitudinally split into two (or more) semicircular handle portions **14*a* and 14*b* (FIG. 1). Similarly, cutting guide 15 includes two arc-shaped cutting guides 15*a* and 15*b*, each extending radially outward from an extremity of one of the handles 14*a* and 14*b*. Cutting guides 15*a* and 15*b* are connected at the extremity of one of the longitudinal slots by an integral "living" hinge 18. As a result, shade holder 11 can open clam-like to receive a rolled shade between its two sides, one side including holder handle 14*a* and integral cutting guide 15*a*, and the other side including holder handle 14*b* and integral cutting guide 15*b***.

Figure 2:
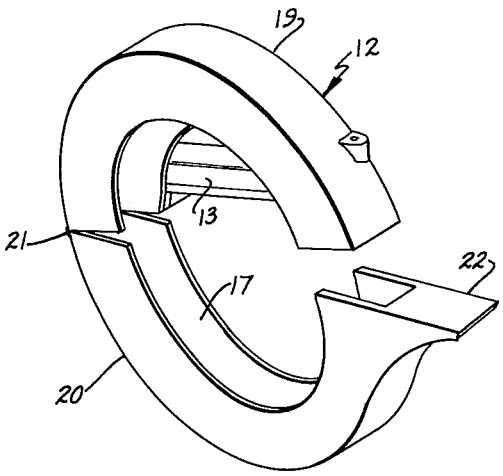
FIG. 2 is a rear perspective view of a blade holder in accordance with an embodiment of this invention.

Blade holder 12 includes an upper cutting member 19 (FIGS. 2 and 3) and a lower support member 20. Each member is shaped as a semi-circular arc and is of channel-like cross section, having a guide groove 17 opening towards the center and extending around the entire interior circumference. Accordingly, a cross section of members 19 and 20 is generally U-shaped (see FIG. 4) with side walls **12*a*, 12*b* and 12*c*, defining the guide groove 17 which opens towards the center to receive cutting guide 15. Members 19 and 20 are joined at a longitudinal integral hinge 21 connecting the respective outer walls 12*c* of upper cutting member 19 and lower support member 20**.

Figure 5:
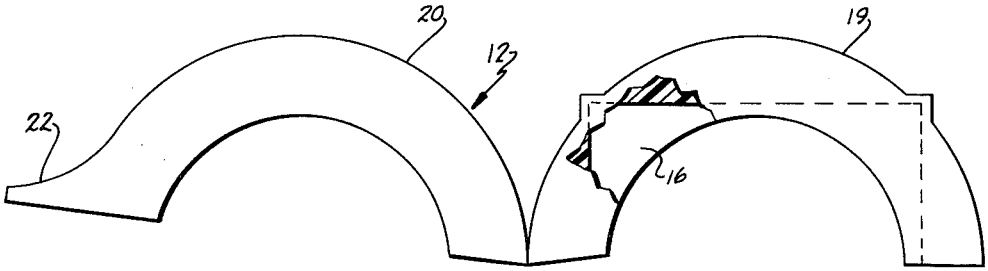
FIG. 5 is a rear elevational view, partially broken away, of a blade holder in an open position in accordance with the preceding figures.
Figure 6:
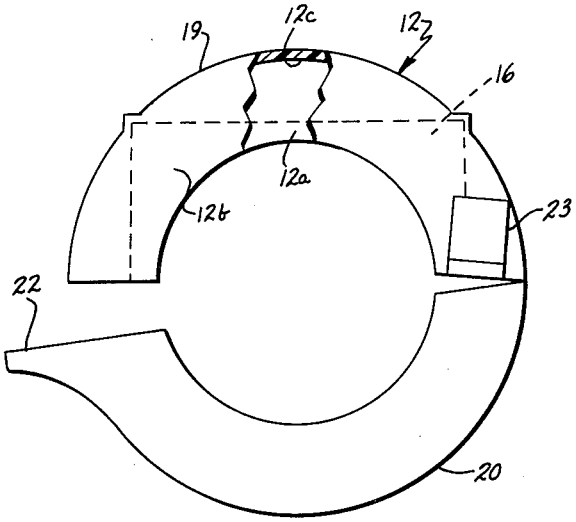
FIG. 6 is a front elevational view of the blade holder of the previous figures in a closed position.

Upper cutting member 19 has a blade mounting slot 16 (FIGS. 4, 5 and 6) formed into side wall **12*b* so that blade mounting slot 16 is spaced from cutting guide 15 and is in a plane perpendicular to the longitudinal axis of shade holder 11. Blade 13 is positioned within blade mounting slot 16 so that a cutting edge 13*a* of blade 13 extends across the end opening of handle 11 and blade 13 is perpendicular to a plane dividing upper cutting member 19 from lower support member 20. To provide for easy turning of blade holder 12, lower support member 20 has a tab 22 extending radially outward from outer wall 12*c* at a point opposite from hinge 21. Analogously, upper cutting member 19 has a tab 23 extending longitudinally outward and forward from side wall 12*b* adjacent hinge 21. Advantageously, tabs 23 and 22 have a curved surface adapted for engagement by fingers for turning of blade holder 12**.

The shade holder handle 14 is sufficiently long to firmly support shade holder 11 up on a shade without having cutting guide 15 wobble or move easily. Too short a holder handle 14 would permit overly easily relative movement of the shade and might cause blade 13 to make a diagonal or irregular cut through the shade instead of making the desired straight perpendicular cut. A satisfactory length for holder handle 14 is on the order of at least two and one-eighth inches, and a typical diameter is approximately one and three-eighths inches. Other typical dimensions include: two and one-half inch outer diameter of cutting guide 15, one-fourth inch longitudinal thickness of cutting guide 15, two and three-fourths inches outer diameter of blade holder 12, and about one-half inch protrusion for tabs 22 and 23.

Figure 7:
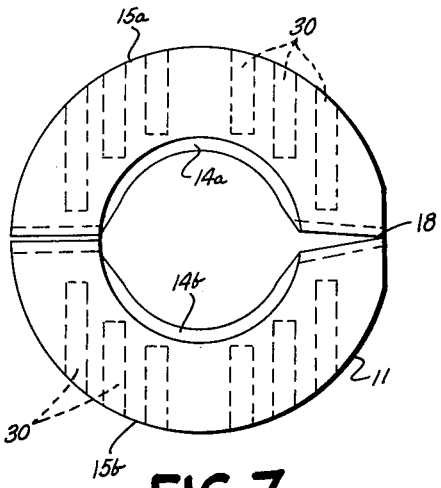
FIG. 7 is a rear elevational view of a modified form of a shade holder, shown in a closed position, in accordance with another embodiment of this invention.
Figure 8:
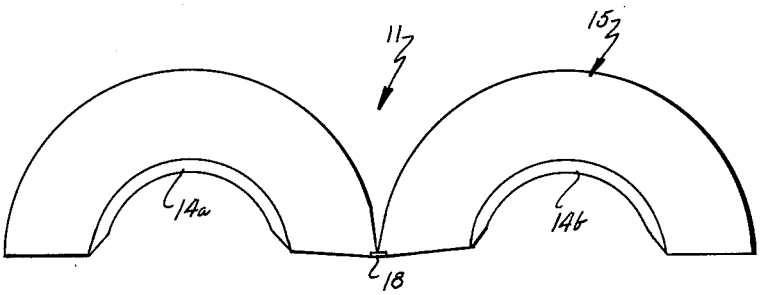
FIG. 8 is a front elevational view of the shade holder of FIGS. 1-3, shown in an open position.

Shade holder 11 and blade holder 12 may advantageously be injection-molded of a relatively inexpensive plastic material for ease of fabrication and to reduce cost. A typical blade 13 is an industrial type heavy duty blade such as a Durham duplex blade. If desired, to reduce the quantity of plastic material used in shade holder 11, a plurality of cylindrical or other openings 30 (shown in phantom lines in FIG. 7) can be formed into the rectangular cross section of cutting guide 15.

Figure 9:
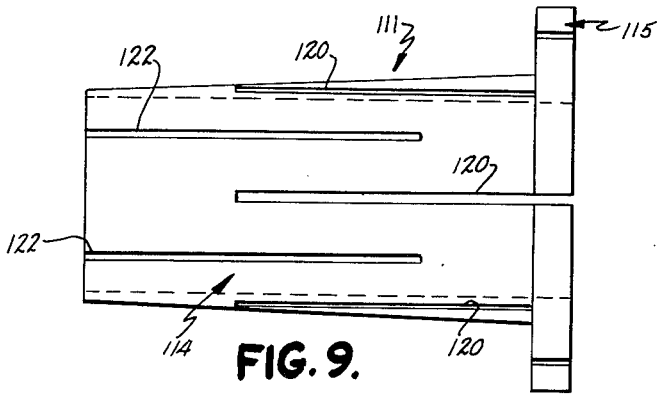
FIG. 9 is a side elevational view of another embodiment of a shade holder in accordance with the present invention.
Figure 10:
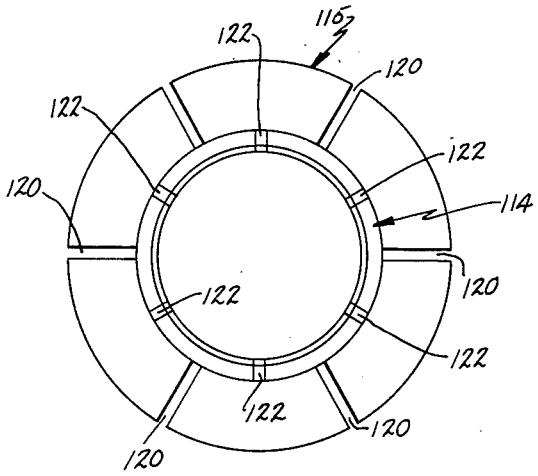
FIG. 10 is an end elevational view of the shade holder shown in FIG. 9, as seen from the left.
Figure 11:
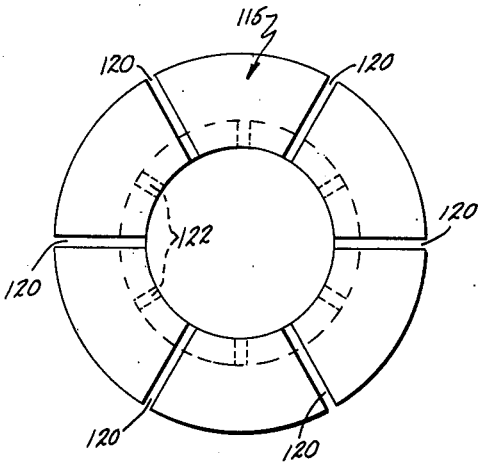
FIG. 11 is an end elevational view of the shade holder of FIG. 9, as seen from the right.

The embodiment of the shade holder 111 shown in FIGS. 9–11 has a number of features in common with, or similar to, features of the shade holder 11 discussed previously, including the basic overall size and shape, as well as the integral cutting guide 115, for cooperation with the same blade holder 12 discussed above. However, the shade holder 111 is illustrated as having a series of longitudinal slots 120, 122, which in the preferred embodiment are equally spaced and extend inwardly from each end in alternating fashion.

As illustrated in FIGS. 10 and 11, a specific arrangement is to use six of the slots 120 extending inwardly from, and through, the cutting guide 115, and six of the slots 122, also equally spaced, and disposed midway between the slots 120 around the circumference of the shade holder. As also indicated, each of the slots extends approximately two-thirds the length of the shade holder, overlapping one another circumferentially over approximately the central third of the handle, or barrel, 114.

With this arrangement, the shade holder 111, which like the shade holder 11 of the previous embodiment may conveniently be injection-molded of a suitable plastic, preferably of a stiffly flexible character, is rendered diametrically expansible and contractible by virtue of its slotted nature and its structural flexibility. That is, the diameter of either end may be enlarged by annularly squeezing the opposite end, as for example to admit insertion of a rolled shade whose outside diameter is somewhat larger than the nominal inside diameter of the shade holder. Following initial insertion in this manner, the shade holder may be pushed into place longitudinally over the rolled shade, expanding the diameter of the shade holder all along its length by virtue of spreading each of the various slots. Conversely, the shade holder may be diametrically contracted tightly about the shade extending through it, and this may also be done with a rolled shade whose diameter is somewhat less than the nominal inside diameter of the shade holder.

Figure 12:
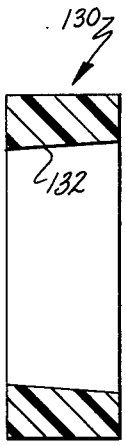
FIG. 12 is a central sectional side elevation of a clamping ring for the shade holder.
Figure 13:
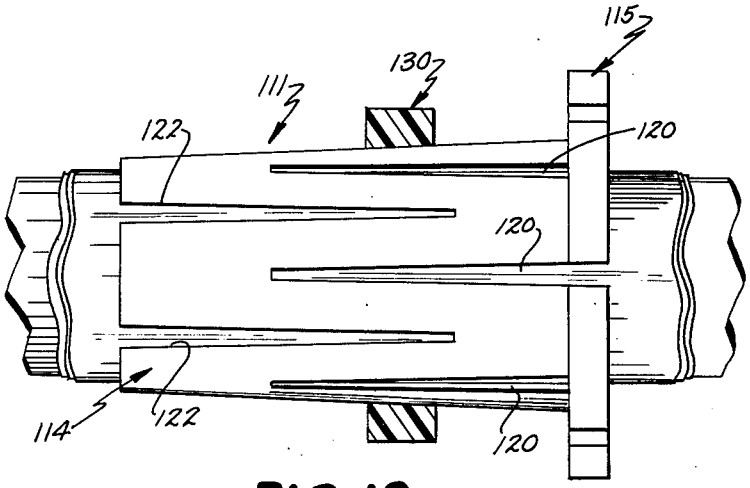
FIG. 13 is a fragmentary side elevational view showing a shade clamped within the shade holder of FIGS. 9–11, with the clamping ring shown in section.

While manual squeezing pressure may be employed to cause the shade holder 111 to grip a shade extended through it (as discussed above in connection with the shade holder 11), the annular collar 130 seen in FIG. 12 is provided as a mechanical way of constricting the shade holder about a rolled shade and locking the shade holder in this position. In this connection, the shade holder 130 preferably has a conically tapered interior surface 132, and the barrel or handle portion 114 of the shade holder preferably has a similar conical taper (although strictly speaking it is not necessary for both members to have such a taper). The inside diameter of the locking collar 130 at its largest end is preferably about the same as the outside diameter of the handle portion 114 at a point near the cutting guide 15, whereas the inside diameter of the locking collar at its opposite end is approximately the same as the diameter of the shade holder at its smallest end. Thus, the locking collar may be forced onto the shade holder from its smallest end even though the shade holder has been diametrically enlarged somewhat. Of course, as the locking collar is forced progressively along the length of the shade holder handle toward the cutting guide 115, it contracts the diameter of the shade holder, thereby locking the latter in place about a rolled shade. At the same time, the locking collar is wedged firmly in place, and will not slip from a position in which it is so locked.

Figure 4:
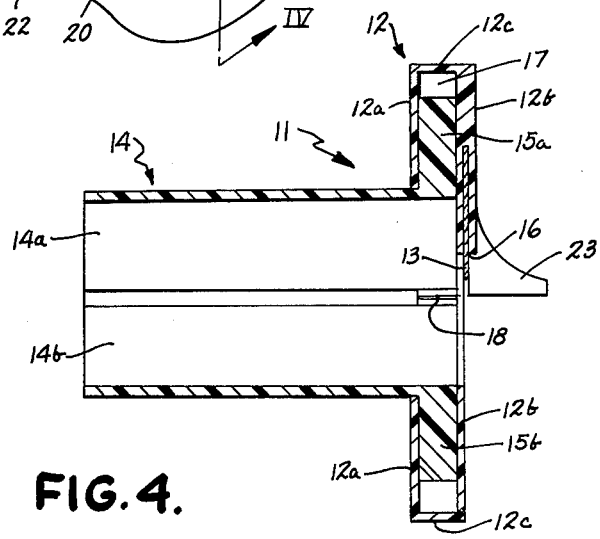
FIG. 4 is a cross-sectional view along section line IV—IV of FIG. 3.

It should be observed that the features of the shade holder embodiment shown in FIGS. 1 and 4 and features of the embodiment shown in FIGS. 9–11 may be used in either such embodiment, and should not be considered mutually exclusive. For example, the locking ring or collar 130 may be used on the embodiment of FIG. 1, and need not be used on that of FIG. 9, which may be operated manually. Also, the embodiment of FIG. 9 may be slotted along its entire length, thereby enabling it to hinge open or closed, whether by an oppositely-disposed thin wall portion (not illustrated), or merely by flexure. Conversely, the embodiment of FIG. 1 may be slotted longitudinally but not hinged, and the exterior periphery of its handle portion may be tapered. Once again, it is not absolutely essential that both the handle portion and the locking collar be tailored to complement one another, since locking may be obtained by tapering only one such member.

OPERATION

To trim off the edge of a shade in accordance with an embodiment of the method and means of this invention, the shade material is rolled about a central support such as a fiber or paperboard tube, or wood rod (which may actually be the roller on which the shade is to be used). The shade and roller are inserted along the longitudinal central opening in the shade holder handle 14, or 114. Advantageously, shade holder 11 is opened about hinge 18 to receive the shade roller and then hinged, closed and squeezed upon the shade roller (manually and/or by use of a clamping collar, as may be desired) to apply annular pressure to it, with the position of the desired cut on the shade located immediately outwardly from the outer edge of cutting guide 15 at a spacing therefrom equal to about one-half of the width of side leg **12*b* of blade holder 12, or, for example, about one-sixteenth inch. When using shade holder 111**, the central opening may be slightly larger than the rolled shade diameter so as to permit direct telescoping insertion; if this form of slotted but not hinged shade holder is used, it may be opened diametrically at one end (at least to a certain extent) by squeezing the other end, or by merely pushing it over the rolled shade to force expansion of the associated end of the holder. Following such insertion, the shade holder is squeezed about the shade to hold the selected position for cutting, as in the case of the other embodiment.

Blade holder 12 is then opened, i.e., spread apart by rotating upper cutting member 19 away from lower support member 20, about hinge 21. Guide groove 17 is aligned with cutting guide 15, or 115, and upper cutting member 19 is brought towards lower support member 20 so that side legs 12 and **12*b* come together about the cutting guide to prevent longitudinal motion of the shade holder with respect to blade holder 12**.

To begin cutting, the roller shade is held stationary with respect to the shade holder by manually applying pressure to the shade holder handle, or by use of the clamping ring 130. A force is applied, preferably by fingers, to tabs 22 and 23 in the direction of the arrows seen in FIG. 3, thereby rotating blade holder 12 with an action similar to that of screwing a large wing nut. Advantageously, a light force is initially applied to facilitate accurate initial cutting.

After an initial amount of cutting has been made, the effective cutting force applied can be increased. For example, if desired, the entire outer perimeter of blade holder 12, i.e., outer wall **12*c*** can be grasped and a very strong force applied. Such an increased application of force is particularly advantageous to cut through very thick shades, or even more particularly, to cut off a portion of the underlying shade roller. That is, the same cutting path which serves an end of the rolled shade may merely be continued onward through the roller itself, thereby shortening the roller to accommodate the trimmed, narrowed shade at the same time. Of course, the user may also stop cutting at the point where only the shade material has been cut, leaving the shade roller uncut.

Various modifications and variations will no doubt occur to those skilled in the various arts to which this invention pertains. For example, the engagement between the blade holder and the cutting guide may be V-shaped or some other appropriate shape instead of the "U"-shape disclosed above. Also, the extent of blade exposure beyond the open semi-circular recess inside arcuate cutting member 19 may be varied over a considerable range, from the almost diametral chord illustrated herein to a much lesser degree, although enough blade exposure must be used to provide the maximum cutting depth desired. Similarly, the shape and angular positioning of the blade may be varied, i.e., blade positions may be used which are angled rather than parallel to that diameter which bisects integral hinge 18, and a generally semi-circular or other curved blade may be used, all of which may be made replaceable within the blade mounting slot if desired. These and all variations which basically rely on the teachings through which this disclosure has advanced the art are properly considered within the scope of this invention as defined by the appended claims.

The embodiments of the invention in which an exclusive property or privilege is claimed are defined as follows.

1. A manual window shade cutter assembly for cutting a generally cylindrical rolled shade including:

a longitudinally slotted shade holder having a handle portion of a size and shape to be gripped by the human hand and with longitudinally-extending slot-like separations dividing at least parts of said handle portion into component portions, said slotted shade holder having a longitudinal internal opening shaped to support a rolled shade during cutting and having an integral cutting guide oriented transversely of said internal opening and defining a generally annular wall portion;

a generally annular blade holder having a hinge and a separation dividing said blade holder into at least two relatively moveable hinged members; each of said members having a circularly curved follower portion whose radii converge toward the center of said blade holder; one of said blade holder members having a blade-supporting slot aligned parallel to said curved follower portion; said curved follower portion of said blade holder shaped to complement and to slideably clamp around said cutting guide of said shade holder to longitudinally position said blade holder for guided relative rotational movement around said shade holder; and a blade within said blade slot and having a cutting edge aligned perpendicular to the longitudinal axis of said blade holder.

2. A manual shade cutter assembly as recited in claim 1 wherein:

said blade holder defines an integral hinge with a hinge axis parallel to the central axis of the blade holder and located at the periphery thereof, said blade holder including two generally semi-circular portions hinged together by said integral hinge and each defining a generally U-shaped channel disposed transversely with respect to the central axis of the blade holder, said channel defined by two side walls generally perpendicular to the longitudinal axis of said blade holder and an outer wall connecting said side walls, said walls defining a recessed groove which opens towards the center of the semi-circular portions, said groove comprising said curved follower portion.

3. A manual shade cutter assembly as recited in claim 2 further comprising:

at least one tab extending outward from a first one of said semi-circular portions of said blade holder;

said tab having a size and shape to provide finger engagement by a user to facilitate rotation of the blade holder around the shade holder at least in part by means of finger pressure on said tab.

4. A manual shade cutter assembly as recited in claim 3 further comprising:

a second tab extending outward from the other of said semi-circular portions of said blade holder;

both said first and second tabs being adapted to be engaged by fingers and cooperatively applying a force to said blade holder to rotate said blade holder relative to said shade holder.

5. A manual shade cutter assembly as recited in claim 4 wherein at least one of said finger-engaging tabs extends generally radially outward from its respective semi-circular portion of the blade holder.

6. A manual shade cutter assembly as recited in claim 4 wherein at least one of said finger-engaging tabs extends outward from its respective semi-circular blade holder portion in a direction generally longitudinally of the blade holder.

7. A manual shade cutter assembly as recited in claim 1 wherein at least one of said blade holder and said shade holder is formed as one piece and molded of a plastic material.

8. A manual shade cutter assembly as recited in claim 1 wherein said shade holder comprises a tubular member having said internal opening as the internal tubular passage of the tubular member and having said handle portion on the outer periphery of the tubular member.

9. A manual shade cutter assembly as recited in claim 8 wherein said handle portion comprises a generally cylindrical surface extending generally parallel to the axis of said tubular passage.

10. A manual shade cutter assembly as recited in claim 9 and including a diameter-restraining annular member disposed about said generally cylindrical surface to clamp the tubular internal passage about the rolled shade.

11. A manual shade cutter assembly as recited in claim 10 wherein at least one of said generally cylindrical surface and said annular member includes a surface for mating contact with the other, and including means on said surface for frictional engagement with said other to anchor the annular member in fixed position along the length of said generally cylindrical surface.

12. A manual shade cutter assembly as recited in claim 11 wherein said means on said surface includes a tapered portion for wedging contact with said other such member.

13. A manual shade cutter assembly as recited in claim 12 wherein both said generally cylindrical surface and said annular member have tapered mating surfaces shaped to complement and wedge upon one another.

14. A manual shade cutter assembly for cutting an elongated member such as a rolled shade, a shade support roller, or the like, comprising:

a manually-held shade holder having an elongated tubular portion for receiving and caging a rolled shade and an integral radial flange with a circularly curving periphery extending around said tubular portion and having a side surface for indicating the position on the shade to be cut, said flange serving as a guide; said shade holder having opposing longitudinal slots dividing said shade holder into symmetrical portions; the peripheral edges of said flange adjacent a longitudinal slot being joined by an integral hinge thereby providing for hinged opening and closing movement between said symmetrical portions of said shade holder;

a generally annular blade holder having a circularly shaped guide along its inner face; said guide oriented toward the center of said blade holder and being bounded by two side walls; said annular blade holder having opposing longitudinal slots dividing said blade holder into at least two portions; the adjacent outer walls at one of said longitudinal slots being joined by an integral hinge thereby providing for hinged opening and closing movement between said portions of said blade holder so said blade holder can be coupled to said shade holder by having said radial flange engaging in said guide; one of said blade holder portions having a blade-supporting structure adjacent one of said side walls, disposed to support a blade with its edge oriented toward the center of said blade holder and extending substantially parallel to said radial flange when said blade holder is mounted on said shade holder; a first protrusion extending longitudinally outward from a wall of one of said blade holder portions adjacent said hinge of said blade holder; a second protrusion extending outward from the walls of the other of said blade holder portions adjacent one of said longitudinal slots; and said first and second protrusions being adapted to be engaged by fingers and cooperatively applying a force to said blade holder to rotate said blade holder relative to said shade holder; and a blade supported by said blade-supporting structure and having a cutting edge aligned generally perpendicular to the longitudinal axis of said shade holder.

* * * * *